US012264583B2

(12) United States Patent
Rantanen et al.

(10) Patent No.: US 12,264,583 B2
(45) Date of Patent: Apr. 1, 2025

(54) HYDRAULIC SYSTEM WITH SAFETY MODE, ROCK DRILLING RIG AND METHOD

(71) Applicant: SANDVIK MINING AND CONSTRUCTION OY, Tampere (FI)

(72) Inventors: Juho Rantanen, Tampere (FI); Pertti Parkkinen, Tampere (FI); Samuli Verho, Tampere (FI); Harri Vatanen, Tampere (FI); Teemu Hongell, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 0 days.

(21) Appl. No.: 18/694,639

(22) PCT Filed: Sep. 20, 2022

(86) PCT No.: PCT/EP2022/076002

§ 371 (c)(1),
(2) Date: Mar. 22, 2024

(87) PCT Pub. No.: WO2023/046647

PCT Pub. Date: Mar. 30, 2023

(65) Prior Publication Data

US 2024/0392628 A1 Nov. 28, 2024

(30) Foreign Application Priority Data

Sep. 24, 2021 (EP) ..... 21198713

(51) Int. Cl.
*E21B 7/02* (2006.01)
*E21B 44/02* (2006.01)

(52) U.S. Cl.
CPC ..... *E21B 7/022* (2013.01); *E21B 7/025* (2013.01); *E21B 44/02* (2013.01)

(58) Field of Classification Search
CPC ..... E21B 7/022; E21B 7/025; E21B 44/02
See application file for complete search history.

(56) References Cited

U.S. PATENT DOCUMENTS

| | | | | |
|---|---|---|---|---|
| 5,778,990 | A * | 7/1998 | Niemi | E21B 44/06 175/122 |
| 2010/0089644 | A1* | 4/2010 | Heemann | E21B 44/06 175/27 |
| 2019/0277311 | A1* | 9/2019 | Verho | E02F 9/2292 |
| 2024/0352954 | A1* | 10/2024 | Parkkinen | F16H 61/4104 |

FOREIGN PATENT DOCUMENTS

| | | | |
|---|---|---|---|
| EP | 3112900 | A1 | 1/2017 |
| EP | 3144465 | A1 | 3/2017 |
| EP | 3536864 | A1 | 9/2019 |

* cited by examiner

*Primary Examiner* — Kristyn A Hall
(74) *Attorney, Agent, or Firm* — Corinne R. Gorski

(57) ABSTRACT

A hydraulic system, rock drilling rig, and method for limiting the output performance of a hydraulic drilling actuator temporarily under execution of a safety function feature of the hydraulic system. The output performance is limited by limiting produced hydraulic fluid flow in a hydraulic circuit of the hydraulic drilling actuator, whereby a restricted magnitude of the fluid flow is produced at a hydraulic pump. This way a restricted operation mode is enabled and is controlled by a control unit.

5 Claims, 3 Drawing Sheets

HYDRAULIC SYSTEM WITH SAFETY MODE, ROCK DRILLING RIG AND METHOD

RELATED APPLICATION DATA

This application is a § 371 National Stage Application of PCT International Application No. PCT/EP2022/076002 filed Sep. 20, 2022 with priority to EP 21198713.6 filed Sep. 24, 2021.

BACKGROUND OF THE INVENTION

The invention relates to a hydraulic system of a rock drilling rig. The hydraulic system is provided with a safety mode for improving safety.

The invention further relates to a rock drilling rig and to a method for ensuring safe operation of a hydraulic drilling actuator.

The field of the invention is defined more specifically in the preambles of the independent claims.

In mines and at other work sites different type of rock drilling rigs are used for drilling blast holes, reinforcing holes and other type of holes by means of rock drilling machines mounted on booms of the rock drilling rigs. The rock drilling machine may be hydraulically operable and may be surrounded by a safety cage or noise dampener, or there may other safety devices preventing entering inside a security zone of rotating machine elements. However, sometimes there is a need to open the safety devices and to assist manually the operative rock drilling work. For such situations, a hydraulic system powering hydraulic actuators of the hydraulic rock drilling machine need to be provided with a safety function feature for limiting their output performance into a safe level. The known safety features and solutions for improving the safety of the hydraulic drilling actuators have shown to have some disadvantages.

BRIEF DESCRIPTION OF THE INVENTION

An object of the invention is to provide a novel and improved hydraulic system, and a rock drilling rig equipped with such hydraulic system, and further to a novel and improved method for improving operational safety by limiting output performance temporarily.

The hydraulic system according to the invention is characterized by the characterizing features of the first independent apparatus claim.

The rock drilling rig according to the invention is characterized by the characterizing features of the second independent apparatus claim.

The method according to the invention is characterized by the characterizing features of the independent method claim.

An idea of the disclosed solution is that a hydraulic system of a rock drilling rig comprises at least one hydraulic circuit provided with a hydraulic power unit comprising a hydraulic pump driven by means of a motor. At least one hydraulic drilling actuator is powered by hydraulic pressure and flow generated by the mentioned hydraulic power unit. Further, the hydraulic system is provided with a safety function feature for limiting features of the input hydraulic fluid directed to the mentioned at least one hydraulic drilling actuator for temporarily limiting output performance of the hydraulic drilling actuator. And wherein the hydraulic system is provided with at least one control unit comprising at least one restricted operating mode (ROM) serving as the mentioned safety function feature and configured to limit magnitude of output flow of the pumping unit whereby motion speed of the drilling actuator is limited due to received limited magnitude of input flow. The hydraulic pump is a fixed displacement hydraulic pump driven by means of an electric motor. The electric motor is controlled by means of at least one electrical motor control device, and the control unit is configured to control the electrical motor control device for controlling rotation speed of the electric motor and the hydraulic pump. Further, the limited output flow of the hydraulic fluid is implemented under control of the control unit in response to the selected restricted operating mode (ROM).

In other words, the output performance of the drilling actuator is limited already at the pumping unit whereby no restricting valves or other control elements are needed in connection with hydraulic channels or at the drilling actuator.

An advantage of the disclosed solution is that since no external valves or valve assemblies are needed in the system, pressure and power losses can be avoided. This applies in the restricted operating mode and in a normal drilling mode. Furthermore, the hydraulic circuits can be simple and may contain fewer components.

A further advantage is that the present solution provides accurate speed control for the controlled hydraulic drilling actuator during the ROM-mode, which is beneficial not only for security issues but also for operational measures.

According to an embodiment, the motor for driving a fixed displacement hydraulic pump is a speed controlled electric motor controlled by means of variable frequency drive serving as an electrical motor control device for controlling rotation speed of the electric motor.

According to an embodiment, the mentioned variable frequency drive comprises an integrated safety function based on hard wired safety circuit.

According to an embodiment, the control unit is provided with at least one input limit value for the restricted operating mode (ROM). The input limit value is configured to define maximum rotation speed of a rotating device of the rock drilling machine and a drilling tool connectable to the rock drilling machine.

According to an embodiment, the input limit value defines maximum magnitude of output flow of the hydraulic fluid produced by the hydraulic pump and directed to at least one hydraulic actuator of the rock drilling machine. The maximum flow is defined so that the maximum rotation speed cannot be exceeded.

According to an embodiment, the control unit is provided with at least one input limit value for the restricted operating mode (ROM). The input limit value is configured to define maximum feed speed of a feed device of the rock drilling machine and a drilling tool connectable to the rock drilling machine. The feed device may be a hydraulic motor or a hydraulic cylinder.

According to an embodiment, the input limit value defines maximum magnitude of output flow of the hydraulic fluid produced by the hydraulic pump and directed to at least one hydraulic actuator of the rock drilling machine. The maximum flow is defined so that the maximum feed speed cannot be exceeded.

According to an embodiment, the control unit is configured to execute the restricted operating mode (ROM) in response to a received safety signal indicating opening or activation of a safety device surrounding the rock drilling machine or being in connection with the rock drilling rig.

According to an embodiment, the safety device is a safety door, a safety cage, or a door of a noise dampener, for example. The safety device may be provided with one or more sensors for monitoring status of the safety device. Further, the safety device may comprise a safety line and a safety switch connected to the safety line.

According to an embodiment, the disclosed solution relates to a rock drilling rig comprising: a movable carrier; at least one boom connected to the carrier; at least one rock drilling unit mounted to a distal end portion of the boom, wherein the rock drilling unit comprises a feed beam and a rock drilling machine mounted movably on the feed beam. The rock drilling rig further comprises a hydraulic system, whereby the rock drilling machine comprises at least one hydraulic actuator powered by the hydraulic system. The hydraulic system is in accordance with the features and embodiments disclosed in this document, whereby the hydraulic actuator of the rock drilling machine is controllable under a restricted operating mode with a limited performance.

According to an embodiment, the disclosed solution relates to method for limiting output performance of a hydraulic drilling actuator temporarily under execution of a safety function feature in a hydraulic system. The method comprises limiting hydraulic features of the input hydraulic fluid directed to the hydraulic drilling actuator connected to a hydraulic circuit of the hydraulic system. The output performance of the drilling actuator is limited by limiting produced hydraulic fluid flow in the hydraulic circuit of the hydraulic drilling actuator, whereby restricted magnitude of the fluid flow is produced at a hydraulic pump of the hydraulic circuit for the duration of a restricted operation mode of the safety feature.

According to an embodiment, the disclosed restricted operation mode i.e., ROM-mode may be based on requirements of a standard EN16228 and may comprise the following measures:

Connecting the ROM-mode

1. The safe device is activated.
2. The ROM-mode is activated by means of a separate switch. The switch may be a physical switching device.
3. When the ROM-mode is active, then feeding and/or rotation of the rock drilling machine is controlled actively under control of a control unit.
4. The feeding may be controlled actively under maximum limit value 15 m/min, and the rotation may be controlled actively under maximum limit value 30 rpm. Then movements of the rock drilling machine are executed with sufficiently slow movements. This enables safe working when a protective door or cage is open.

Stopping the ROM-mode and initiating a normal mode

1. Ending the active control in ROM-mode.
2. Deactivate the safety situation of the safety device. Reconnect the safety device into its protective state. Close the protective door or cage, for example.
3. Select the normal mode by means of the switching device.
4. Continue operation in normal mode without restrictions in performance.

The above disclosed embodiments may be combined in order to form suitable solutions having those of the above features that are needed.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF SOME EMBODIMENTS

Figure 1:
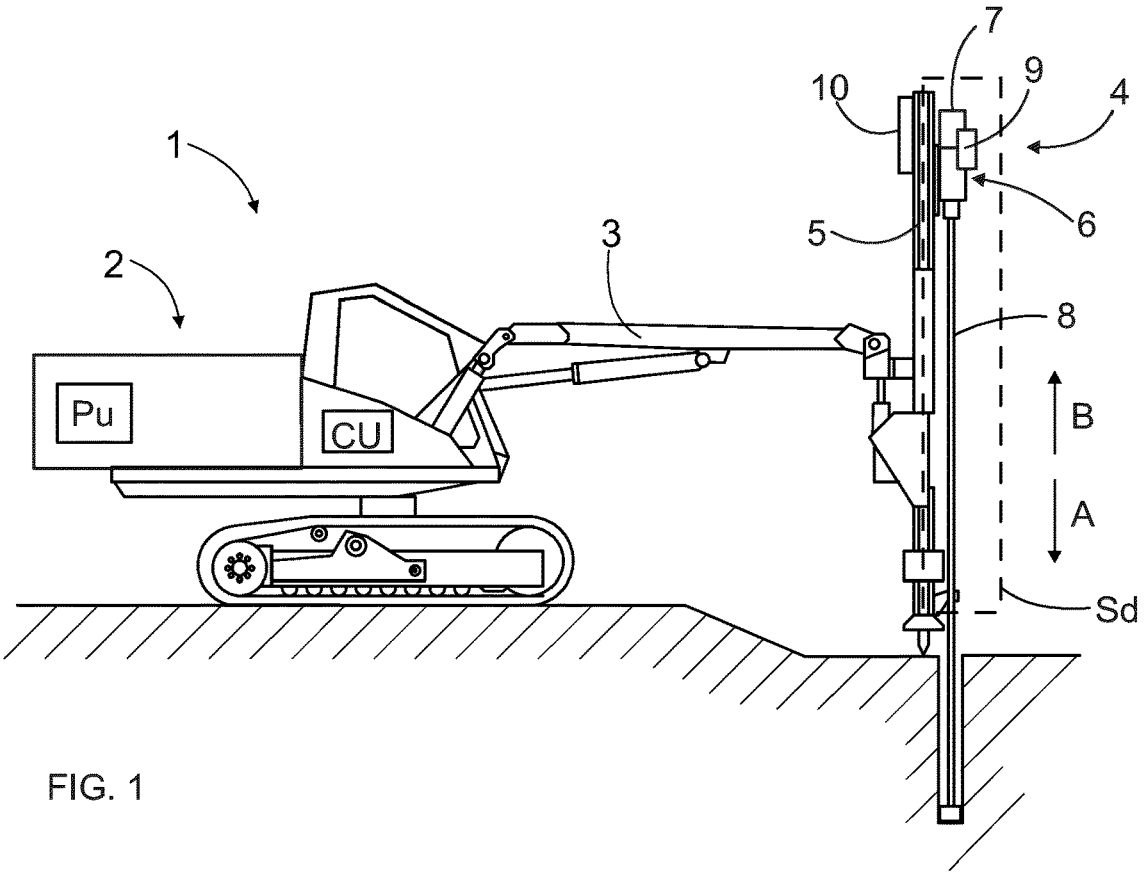
FIG. 1 is a schematic view of a rock drilling rig.

FIG. 1 shows a rock drilling rig 1 comprising a movable carrier 2 and one or more booms 3 connected to the carrier 2. The boom 3 may be provided with a rock drilling unit 4 comprising a feed beam 5 on which is arranged movably a rock drilling machine 6. The rock drilling machine 6 may comprise an impact device 7 for providing a rock drilling tool 8 with impact pulses for breaking rock material being drilled, and a rotating device 9 for rotating the drilling tool 8 around its longitudinal axis. The rock drilling machine 6 is moved in drilling direction A and in reverse direction B by means of a feed device 10. The rock drilling unit 4 may further comprise one or more safety devices Sd such as protective cages, covers, noise dampers or safety lines, for preventing an operator entering close to rotating and moving machine elements.

FIG. 1 further discloses that the rock drilling rig 1 comprises a power unit Pu for producing needed pressurized hydraulic fluid flow to hydraulically operable drilling actuators of the rock drilling unit 4. The rotating device 9 and the feed device 10 may be hydraulically operable drilling actuators driven by the power unit Pu, as well as the impact device 7. There is also one or more control units CU which may be provided with the safety features disclosed in this document.

FIG. 1 discloses a surface rock drilling rig 1 for drilling blast holes, but the solution disclosed in this document can be utilized also in underground drilling and in reinforcing devices, such as in rock bolting solutions.

Figure 2:
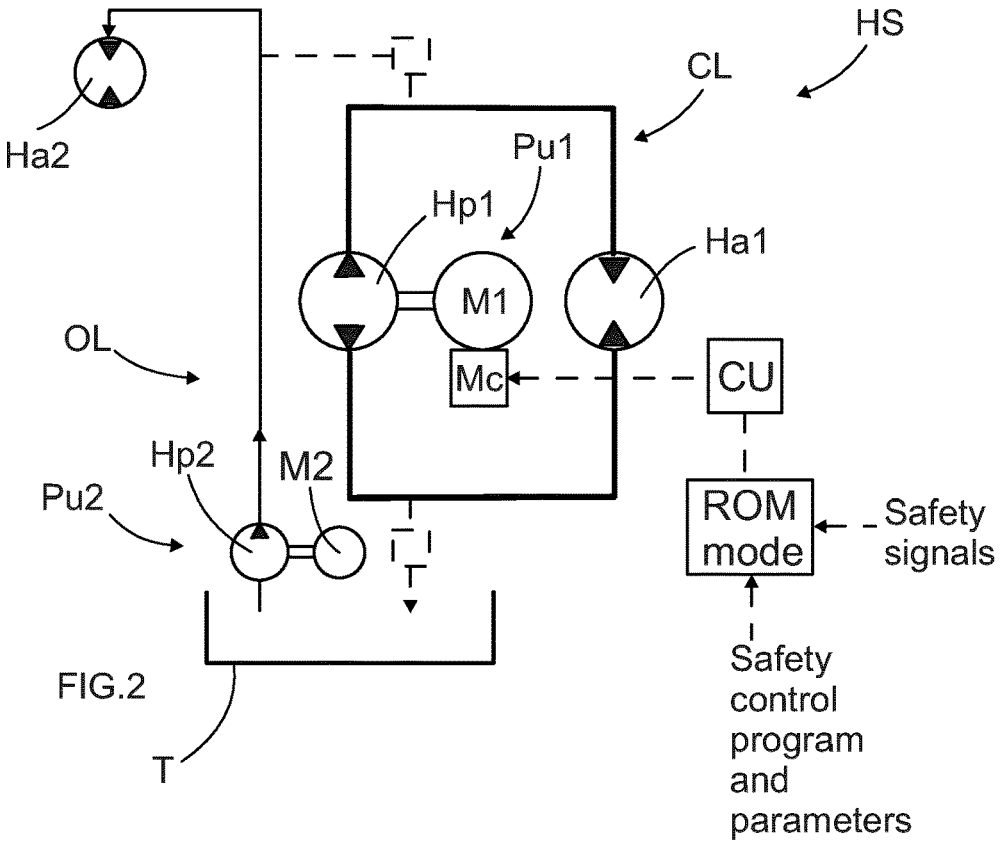
FIG. 2 is a schematic hydraulic diagram of the disclosed hydraulic system provided with safety features.

FIG. 2 discloses a hydraulic system HS of a rock drilling rig. The hydraulic system HS comprises a closed loop hydraulic circuit CL with a first hydraulic power unit Pu1, and an open loop hydraulic circuit OL with a second hydraulic power unit Pu2. The closed loop hydraulic circuit CL comprises a first hydraulic pump Hp1 driven by means of a first motor M1. A first hydraulic drilling actuator Ha1 is connected to the closed loop hydraulic circuit CL. The first hydraulic drilling actuator Ha1 may be a rotating device. As it is shown in FIG. 1, pressurized hydraulic fluid is directed to circulate in the closed loop hydraulic circuit CL from an outlet port of the first hydraulic pump Hp1 to an inlet port of the first hydraulic drilling actuator Ha1 and further from an outlet port of the first hydraulic actuator Ha1 to an inlet port of the first hydraulic pump Hp1. In FIG. 1 the first hydraulic pump Hp1 and the first hydraulic drilling actuator Ha1 can be rotated to both rotational directions wherefore the inlet and outlet ports are not marked for clarity reasons. The first motor M1 can be controlled by means of an electrical motor controller Mc and control signals can be transmitted to the electrical motor controller Mc from a control unit CU. The control unit CU can control for example rotation speed of the first motor M1 accurately and steplessly, and when the first hydraulic pump Hp1 is a fixed displacement pump, then output hydraulic power of the first hydraulic power unit Pu1 can be accurately controlled. The control unit CU may comprise a ROM-mode for interrupting a normal mode and allowing safe and slow motion for the first hydraulic actuator Ha1 for a limited duration. The ROM-mode may comprise a safety control program or algorithm, parameters, and limit values, which can be input to the control unit CU. The control unit CU may also receive safety signals from sensors and safety switches for detecting status of different safety devices, for example. The control unit may comprise a processor for executing the input control programs and for generating the needed control signals.

The open loop hydraulic circuit OL of the hydraulic system of FIG. 2 comprises a second hydraulic pump Hp2 driven by means of second motor M2. The second hydraulic power unit Pu2 is configured to provide hydraulic power to a second hydraulic drilling actuator Ha2, which may be hydraulic feed device. The feed device may be a hydraulic motor or a cylinder. The open loop hydraulic circuit OL may be a so called common rail circuit which may provide hydraulic power also for auxiliary actuators of a rock drilling rig. Hydraulic fluid can be selectively fed from the common rail circuit to the closed loop circuit CL if a supplementary amount of hydraulic fluid is needed therein. This is shown in broken lines in FIG. 2. Contrary to the closed loop hydraulic circuit CL, the open loop hydraulic circuit OL circulates the hydraulic fluid via a tank T or reservoir.

Figure 3:
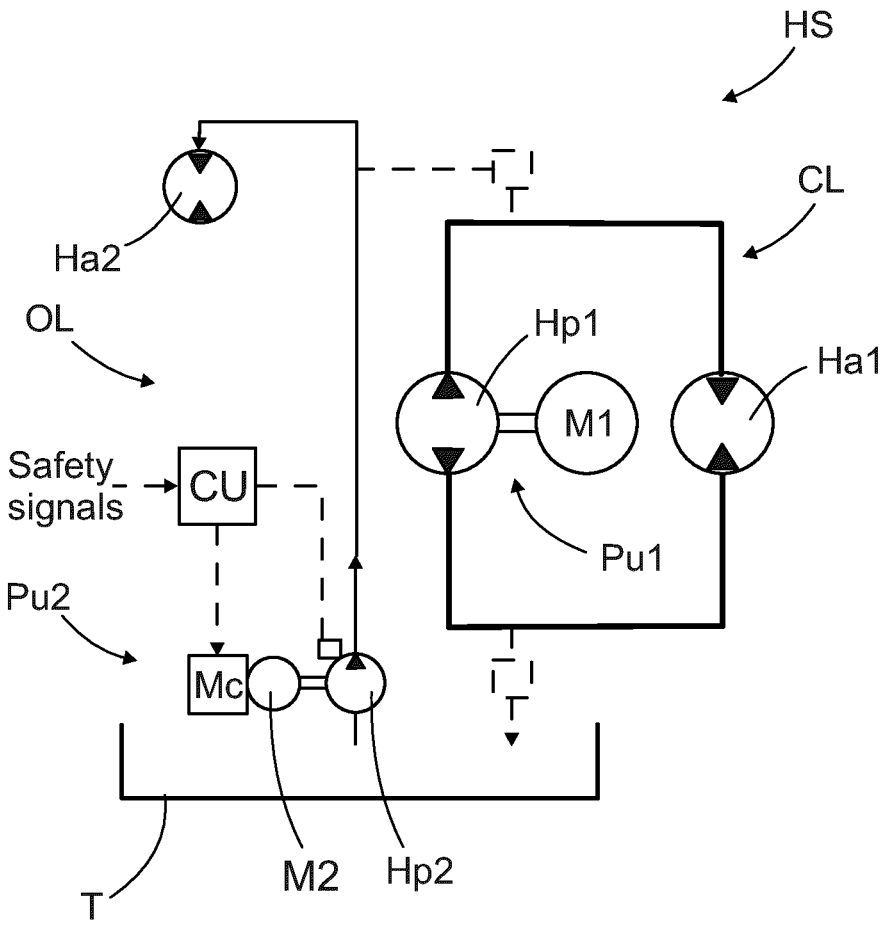
FIG. 3 is a schematic hydraulic diagram of another hydraulic system provided with safety features.

FIG. 3 discloses an alternative hydraulic system HS for providing hydraulic power for two hydraulic drilling actuators Ha1 and Ha2. The hydraulic circuits CL and OL are quite like the ones shown in previous FIG. 2. However, in FIG. 3 the second hydraulic power unit Pu2 of the open loop hydraulic circuit OL is provided with the safety feature control. Then the second motor M2 can be controlled under control of the control unit CU and electrical motor control unit Mc, or alternatively, the second hydraulic pump Hp2 may be a variable displacement pump which can be controlled by means of the control unit CU for adjusting the generated fluid flow.

Figure 4:
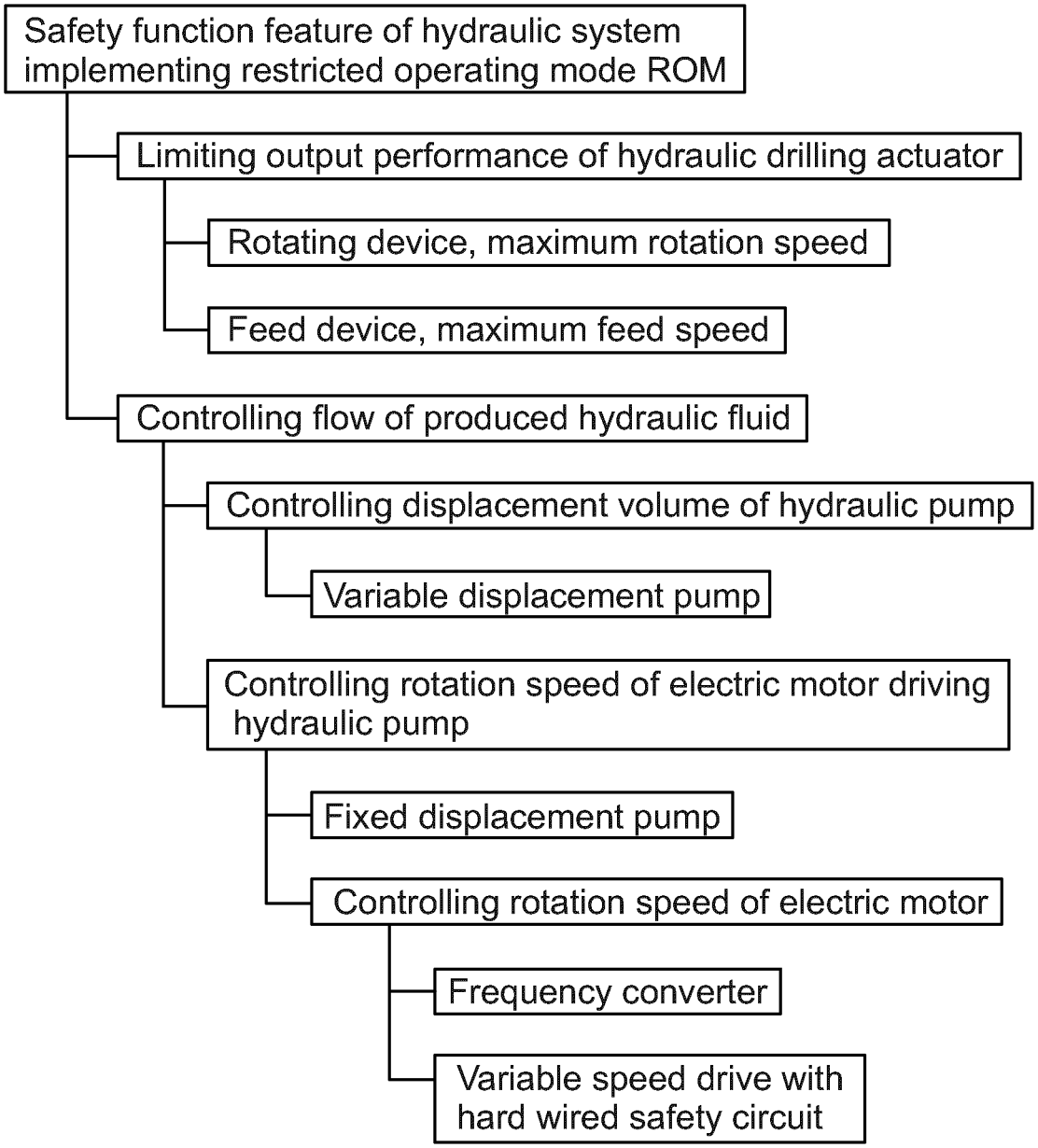
FIG. 4 is a schematic diagram showing some features and principles of the disclosed solution.

FIG. 4 is a summarizing diagram showing some basic features and alternatives of the disclosed solution. These issues are already disclosed above in this document.

The drawings and the related description are only intended to illustrate the idea of the invention. In its details, the invention may vary within the scope of the claims.

The invention claimed is:

1. A hydraulic system of a rock drilling rig comprising:

at least one hydraulic circuit provided with a hydraulic power unit including a hydraulic pump driven by a motor;

at least one hydraulic drilling actuator powered by hydraulic pressure and flow generated by the hydraulic power unit, wherein the hydraulic system is provided with a safety function feature for limiting features of an input hydraulic fluid directed to the at least one hydraulic drilling actuator for temporarily limiting output performance of the hydraulic drilling actuator; and at least one control unit having at least one restricted operating mode serving as the safety function feature and configured to limit magnitude of output flow of the hydraulic pumping unit, whereby motion speed of the hydraulic drilling actuator is limited due to a received limited magnitude of input flow, wherein the hydraulic pump is a fixed displacement pump driven by the motor, which is an electric motor, wherein the electric motor is controlled by at least one electrical motor control device, wherein the control unit is configured to control the electrical motor control device for controlling rotation speed of the electric motor and the hydraulic pump, and wherein the electric motor is a speed controlled electric motor controlled by a variable frequency drive serving as the electrical motor control device, the variable frequency drive including an integrated safety function based on a hard wired safety circuit, the limited output flow of the hydraulic fluid being implemented under control of the control unit in response to the selected at least one restricted operating mode.

2. The hydraulic system as claimed in claim 1, wherein the control unit is provided with at least one input limit value for the at least one restricted operating mode, and wherein the input limit value is configured to define a maximum rotation speed of a rotating device of the rock drilling machine and a drilling tool connectable to the rock drilling machine.

3. The hydraulic system as claimed in claim 1, wherein the control unit is provided with at least one input limit value for the at least one restricted operating mode, and wherein the input limit value is configured to define a maximum feed speed of a feed device feeding the rock drilling machine and a drilling tool connectable to the rock drilling machine.

4. A rock drilling rig, comprising:

a movable carrier;

at least one boom connected to the carrier;

at least one rock drilling unit mounted to a distal end portion of the boom, wherein the rock drilling unit includes a feed beam and a rock drilling machine mounted movably on the feed beam;

a hydraulic system according to claim 1, wherein the rock drilling machine includes at least one hydraulic actuator powered by the hydraulic system;

and wherein the hydraulic drilling actuator of the rock drilling unit is controllable under the at least one restricted operating mode with a limited performance.

5. A method for limiting output performance of a hydraulic drilling actuator temporarily under execution of a safety function feature of a hydraulic system, the method comprising:

limiting hydraulic features of an input hydraulic fluid directed to the hydraulic drilling actuator connected to a hydraulic circuit of the hydraulic system;

limiting an output performance of the hydraulic drilling actuator by limiting produced hydraulic fluid flow in the hydraulic circuit of the hydraulic drilling actuator, whereby a restricted magnitude of the fluid flow is produced at a hydraulic pump of the hydraulic circuit for a duration of a restricted operation mode of the safety function feature;

driving the hydraulic pump by an electric motor; and controlling a rotation speed of the electric motor and the hydraulic pump to produce the a restricted magnitude of flow of the hydraulic fluid, wherein the electric motor is a speed controlled electric motor controlled by a variable frequency drive serving as the electrical motor control device, the variable frequency drive including an integrated safety function based on a hard wired safety circuit.

* * * * *